US011787189B2

(12) United States Patent
Yoshikawa et al.

(10) Patent No.: US 11,787,189 B2
(45) Date of Patent: Oct. 17, 2023

(54) LIQUID EJECTING HEAD AND LIQUID EJECTING APPARATUS

(71) Applicant: CANON KABUSHIKI KAISHA, Tokyo (JP)

(72) Inventors: Shimpei Yoshikawa, Kanagawa (JP); Hiroki Tajima, Kanagawa (JP); Takeho Miyashita, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 8 days.

(21) Appl. No.: 17/348,906

(22) Filed: Jun. 16, 2021

(65) Prior Publication Data

US 2022/0009237 A1 Jan. 13, 2022

(30) Foreign Application Priority Data

Jul. 9, 2020 (JP) ..... 2020-118709

(51) Int. Cl.
*B41J 2/175* (2006.01)
*B41J 2/135* (2006.01)

(52) U.S. Cl.
CPC ..... *B41J 2/17503* (2013.01); *B41J 2/135* (2013.01)

(58) Field of Classification Search
CPC ..... B41J 2/17503; B41J 2/135; B41J 2/1752; B41J 2/17523; B41J 2/01
USPC ..... 347/20
See application file for complete search history.

(56) References Cited

U.S. PATENT DOCUMENTS 6,733,117 B2 5/2004 Tajima et al.
8,434,852 B2 5/2013 Hagiwara
8,491,109 B2 7/2013 Takeda et al.
9,061,497 B2 6/2015 Okubo
9,370,928 B2 6/2016 Toda et al.
9,718,274 B2 8/2017 Inada et al.
9,770,911 B2 9/2017 Inada et al.
10,471,727 B2 11/2019 Muraoka et al.
2002/0118242 A1* 8/2002 Tajima ..... B41J 2/17556 347/17
2005/0122380 A1* 6/2005 Nakamura ..... B41J 2/17513 347/65
2012/0007911 A1 1/2012 Hagiwara
2012/0038708 A1 2/2012 Ishii et al.
2014/0240401 A1 8/2014 Okubo
2015/0251435 A1 9/2015 Miyajima
(Continued)

FOREIGN PATENT DOCUMENTS

CN 13/70682 A 9/2002
CN 16/23787 A 6/2005
(Continued)

OTHER PUBLICATIONS

Extended European Search Report dated Dec. 8, 2021, in European Patent Application No. 21180875.3.
(Continued)

*Primary Examiner* — Matthew Luu
*Assistant Examiner* — Alexander D Shenderov
(74) *Attorney, Agent, or Firm* — Venable LLP

(57) ABSTRACT

A liquid ejecting head and a liquid ejecting apparatus can suppress decrease in ejection accuracy while suppressing increase in cost and decrease in productivity. To this end, a sub-tank is attached to a bottom of a main body part with a greater number of screws on the front side where the stiffness is low than that on the back side where the stiffness is high.

18 Claims, 9 Drawing Sheets

(56) References Cited

U.S. PATENT DOCUMENTS

| | | | |
|---|---|---|---|
| 2016/0339711 | A1 | 11/2016 | Muraoka et al. |
| 2016/0347076 | A1 | 12/2016 | Iwano et al. |
| 2021/0170748 | A1 | 6/2021 | Takagi et al. |

FOREIGN PATENT DOCUMENTS

| | | | |
|---|---|---|---|
| CN | 10/2582258 | A | 7/2012 |
| CN | 10/6183412 | A | 12/2016 |
| EP | 1 231 065 | A2 | 8/2002 |
| JP | 2016-005893 | A | 1/2016 |

OTHER PUBLICATIONS

Office Action dated Nov. 17, 2022, in Chinese Patent Application No. 2021-10759476.3.

* cited by examiner

LIQUID EJECTING HEAD AND LIQUID EJECTING APPARATUS

BACKGROUND OF THE INVENTION

Field of the Invention

The present invention relates to a liquid ejecting head configured to eject liquid and a liquid ejecting apparatus.

Description of the Related Art

As described in Japanese Patent Laid-Open No. 2016-5893, the main body part of a liquid ejecting head on which a sub-tank is mounted tends to have a box shape in which the top and the front are open and the back, the bottom, and both lateral sides are wall portions. The configuration with an open top makes it easy to place the sub-tank into the main body part, and the configuration with an open front makes it easy to arrange the connection portion between the sub-tank and supply tubes in a horizontal direction.

Japanese Patent Laid-Open No. 2016-5893 describes fixing of the sub-tank placed in the main body of the liquid eject head by using screws.

However, in the case where the material of the sub-tank has a higher stiffness than the material of the main body part in a configuration like that of Japanese Patent Laid-Open No. 2016-5893, there is a possibility that an effect of reaction force of a sealing member arranged between the sub-tank and the main body part concentrates in the main body part and the bottom of the main body part deforms. Moreover, the bottom of the main body part does not have uniform stiffness but includes portions with high stiffness and portions with low stiffness, and deformation tends to occur in portions with low stiffness. Deformation of the bottom of the main body part hinders ink from being ejected to a desired position, decreasing the ejection accuracy.

A conceivable method to avoid the above situation is to increase the number of screws used to fix the sub-tank and ensure that the main body part conforms to the sub-tank. In Japanese Patent Laid-Open No. 2016-5893, it can be found that the sub-tank is fixed by using many screws. However, this method requires many screws and increases not only the cost but also the labor in terms of man-hours, leading to a decrease in productivity.

SUMMARY OF THE INVENTION

The present invention thus provides a liquid ejecting head and a liquid ejecting apparatus that can suppress decrease in ejection accuracy while suppressing decrease in productivity.

To this end, a liquid ejecting head of the present invention includes: a tank capable of storing liquid; a main body to which the tank is attached; and an elastic member provided between the tank and the main body and forming a seal between the tank and the main body, in which the tank is attached to the bottom of the main body by using screws, the bottom includes a first region adjacent to a region provided with a wall standing from an end portion of the bottom and a second region adjacent to a region not provided with the wall, and the tank is attached in the second region with a greater number of the screws than that in the first region.

The present invention can provide a liquid ejecting head and a liquid ejecting apparatus that can suppress decrease in ejection accuracy while suppressing increase in cost and decrease in productivity.

Further features of the present invention will become apparent from the following description of exemplary embodiments with reference to the attached drawings.

DESCRIPTION OF THE EMBODIMENTS

First Embodiment

A first embodiment of the present invention is described below with reference to the drawings.

Figure 1:
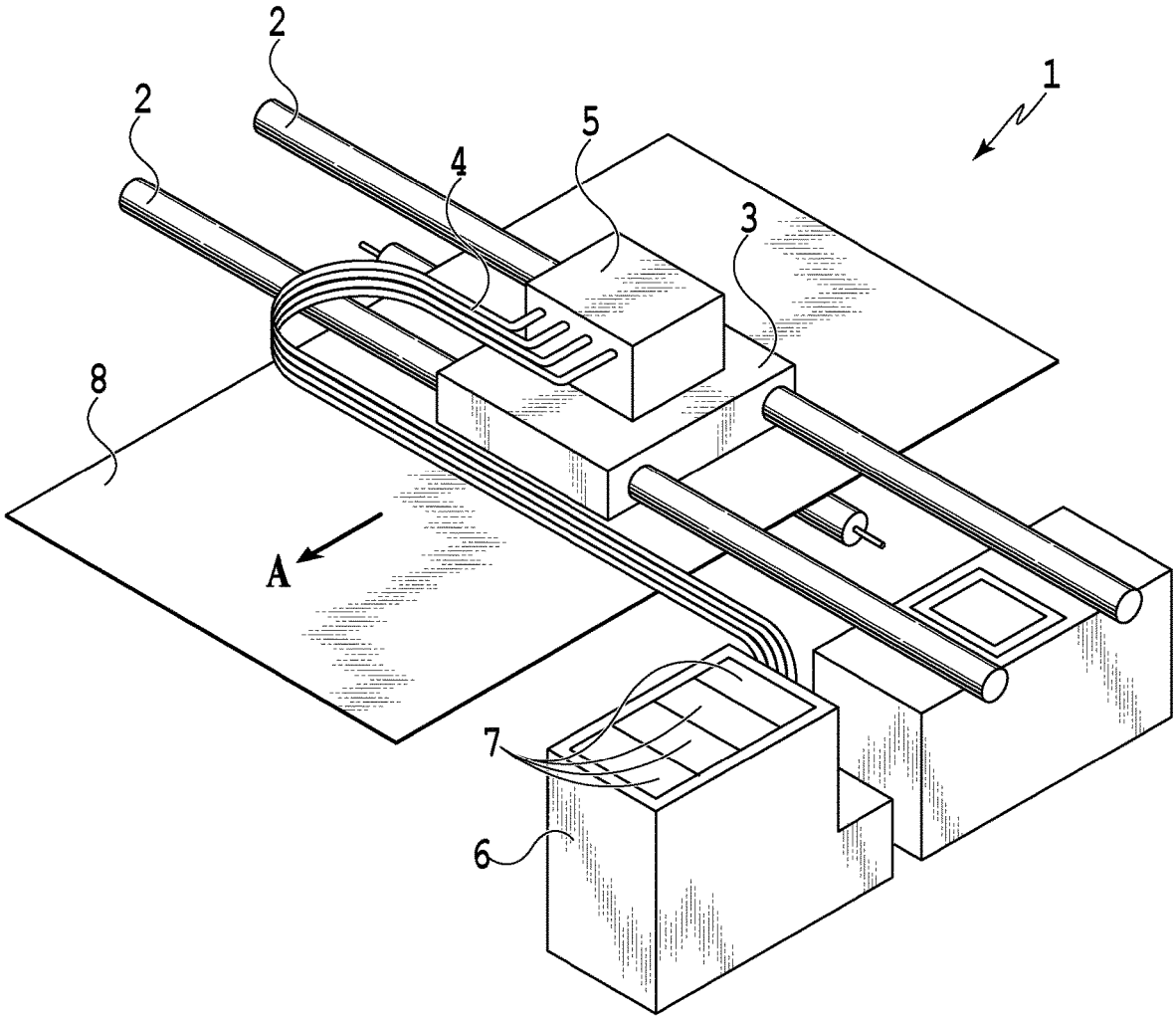
FIG. 1 is a schematic view of a liquid ejecting apparatus.

FIG. 1 is a schematic view of a liquid ejecting apparatus 1 to which the present invention can be applied. The liquid ejecting apparatus 1 includes a liquid ejecting head 5 configured to eject liquid (hereinafter, also referred to as ink), a carriage 3 which is movable along guide rails 2 and on which the liquid ejecting head 5 is mountable, and a supply source 6 configured to supply the liquid to the liquid ejecting head 5 via supply tubes 4. The liquid ejecting head 5 ejects the liquid to a medium 8 being conveyed to perform printing on the medium 8. Multiple ejection ports are provided in the liquid ejecting head 5, and the ink is ejected from the ejection ports by driving actuators such as heaters.

The supply source 6 includes ink storage chambers 7 provided independently for the respective ink colors. In the embodiment, the supply source 6 includes the ink storage chambers 7 for four colors of black (Bk), cyan (C), magenta (M), and yellow (Y). Each ink storage chamber 7 includes a connection port connected to the outside and is configured such that ink can be directly added to the ink storage chamber 7 from the outside. The supply source 6 may be replaceable ink tanks.

Figure 2:
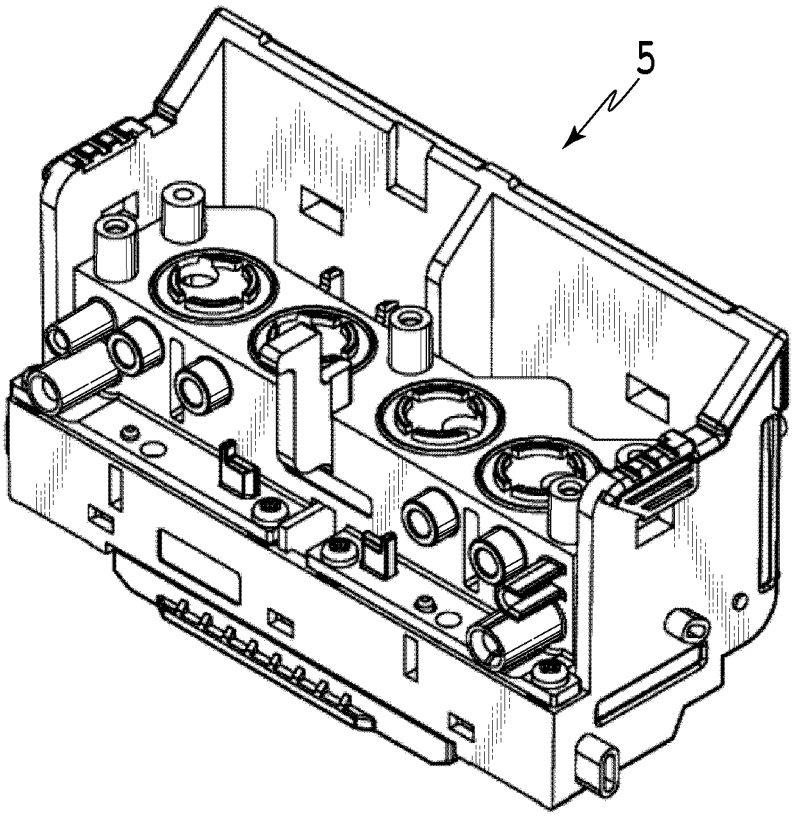
FIG. 2 is a perspective view of a liquid ejecting head.
Figure 3:
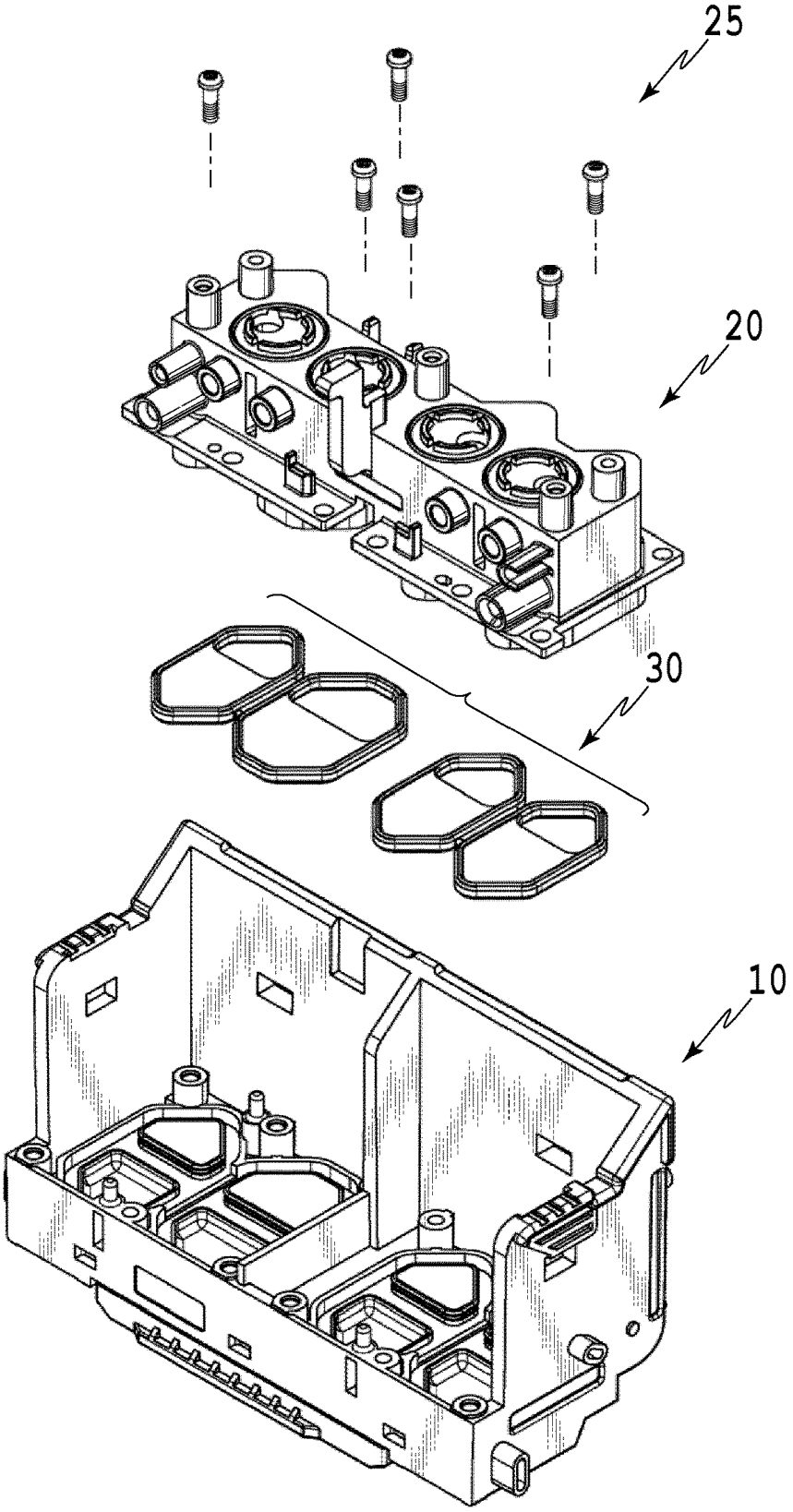
FIG. 3 is an exploded perspective view of the liquid ejecting head.

FIG. 2 is a perspective view of the liquid ejecting head 5, and FIG. 3 is an exploded perspective view of the liquid ejecting head 5. The liquid ejecting head 5 includes a box-shaped main body part 10 and a sub-tank (tank) 20 that is attached to the main body part 10 and that is capable of storing the liquid. Elastic members 30 are provided between the main body part 10 and the sub-tank 20 and form seals between the main body part 10 and the sub-tank 20. The sub-tank 20 is fixed to the main body part 10 with multiple screws 25. The main body part 10 is made of a non-filler resin material and has low stiffness. The sub-tank 20 is made of a resin material containing filler and has high stiffness.

Figure 4A:
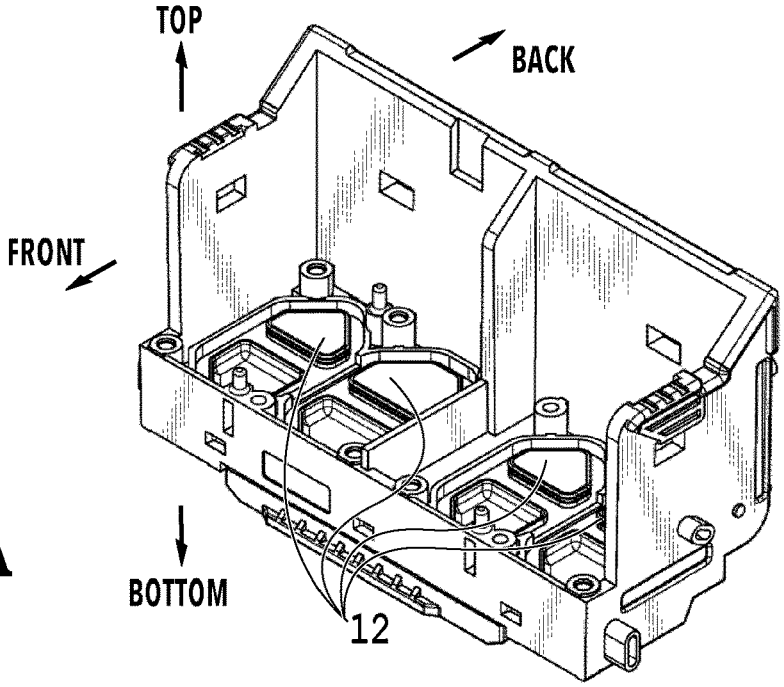
FIG. 4A is a view of a main body part.
Figure 4B:
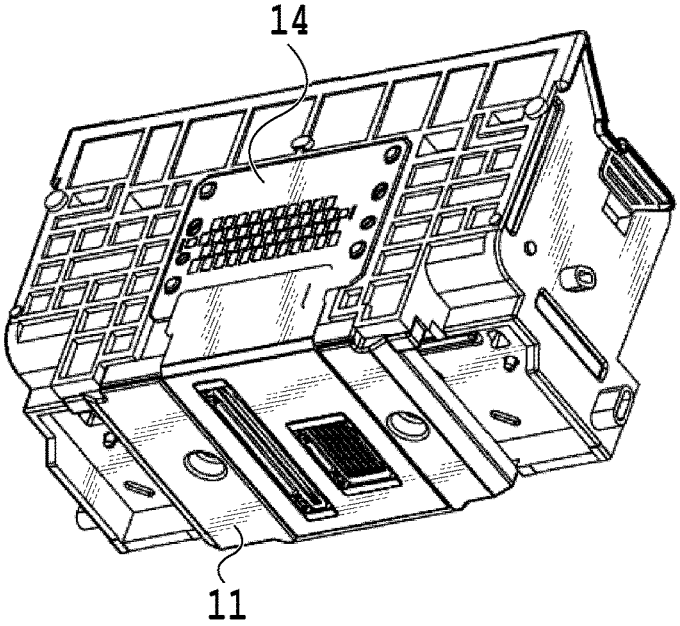
FIG. 4B is a view of the main body part.
Figure 4C:
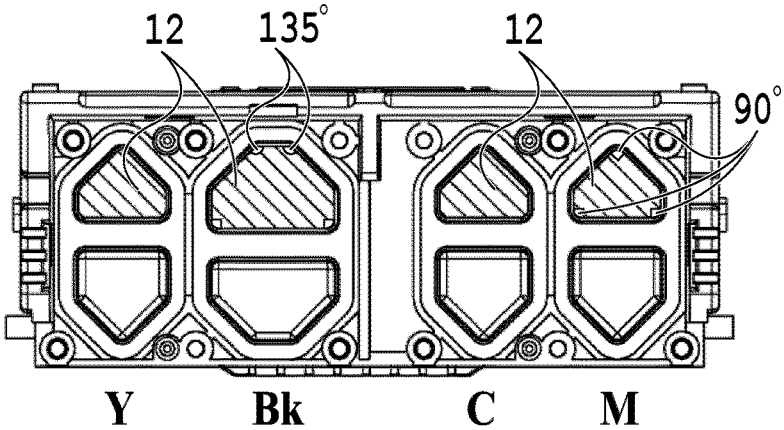
FIG. 4C is a view of the main body part.

FIG. 4A is a perspective view of the main body part 10 in which the front side thereof is visible, and FIG. 4B is a perspective view of the main body part 10 in which the back side thereof is visible. FIG. 4C is a top view of the main body part 10. The main body part 10 has a box shape. The top and the front of the main body part 10 are open while the back, the bottom, and both lateral sides of the main body part 10 are walls. In this case, the bottom of the main body part 10 refers to the portion to which the sub-tank 20 is attached (fixed). An ejection unit 11 is connected to the outside of the bottom portion, and filters 12 configured to prevent entrance of dust and the like are provided on the inside of the bottom portion. The outside of the bottom portion refers to the face opposite to the bottom of the main body part 10.

The inside of the bottom portion refers to the face on the side of the bottom of the main body part 10 to which the sub-tank 20 is attached. The filter 12 corresponding to the black (Bk) ink has a hexagonal shape, and the ones corresponding to the inks of the other colors, which are cyan (C), magenta (M), and yellow (Y), have pentagonal shapes. Later-described inner flow passages capable of supplying the inks from the filter portions to the ejection unit 11 are formed in an interior of the bottom portion of the main body part 10. An electric wiring board 14 for electrical connection with a main body of the liquid ejecting apparatus 1 is provided on the outside of the back of the main body part 10.

Figure 5A:
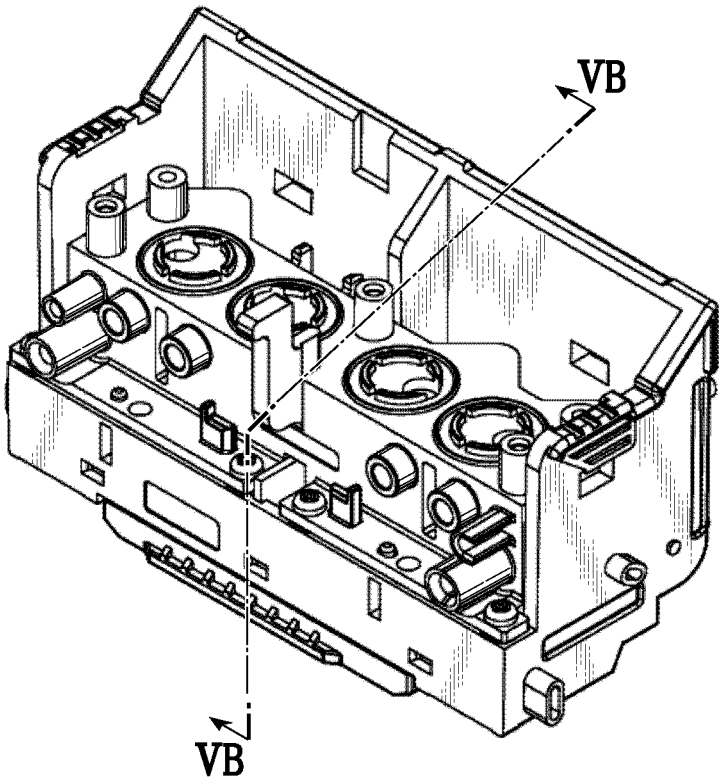
FIG. 5A is a view of the liquid ejecting head.
Figure 5B:
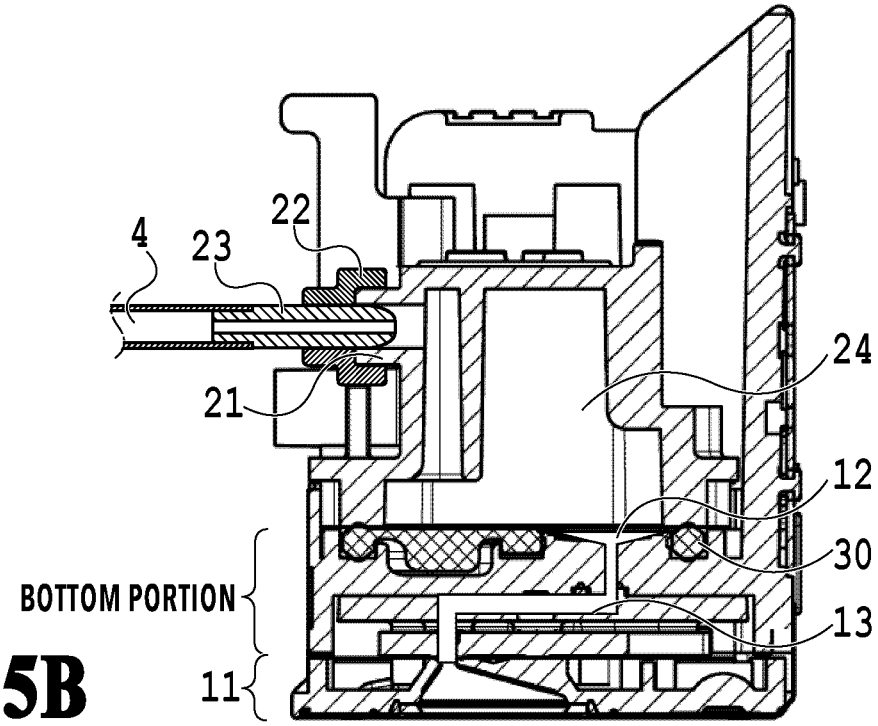
FIG. 5B is a view of the liquid ejecting head.

FIG. 5A is a perspective view of the liquid ejecting head 5, and FIG. 5B is a cross-sectional view along the line VB-VB in FIG. 5A. The ink is supplied from the supply source 6 to an ink chamber 24 in the sub-tank 20 via the supply tube 4 through a joint portion 21. The elastic member 30 forms a seal between the filter 12 of the main body part 10 and the ink chamber 24 of the sub-tank 20, and the ink supplied to the ink chamber 24 passes the filter 12 of the main body part 10 and is supplied to the ejection unit 11 via an inner flow passage 13. A joint needle 23 made of a resin is provided at a front end of the supply tube 4, and a joint sealing member 22 is attached to the joint portion 21 of the sub-tank 20. The joint needle 23 is inserted into the joint sealing member 22 and sealed, and thereby the supply tube 4 and the ink chamber 24 of the sub-tank 20 are connected to each other.

Figure 6:
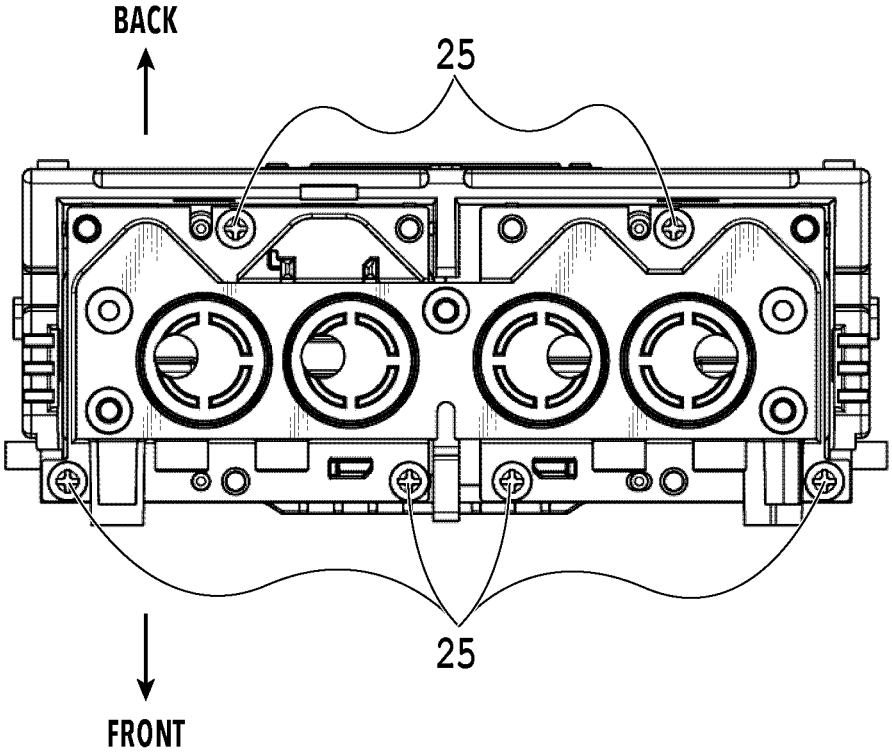
FIG. 6 is a top view of the liquid ejecting head.

FIG. 6 is a top view of the liquid ejecting head 5. The sub-tank 20 is attached to the main body part 10 by using the multiple screws 25 as described above.

In this case, as described also in FIGS. 4A to 4C, the main body part 10 has a box shape, and the top and the front of the main body part 10 are open while the back, the bottom, and both lateral sides of the main body part 10 are walls. The sub-tank 20 is attached to the bottom of the main body part 10, and the stiffness of the bottom of the main body part 10 is different depending on the position due to the shape of the main body part 10. Specifically, since the front of the main body part 10 is open and has no wall standing from the bottom, the stiffness of the bottom is low in a front side center portion (second region).

In contrast, since the back and the lateral sides of the main body part 10 have walls standing from the end portions of the bottom, the stiffness of the bottom is high in sections (first region) on the back side and the lateral sides that are adjacent to the walls. In the case where the bottom of the main body part 10 is assumed to have a rectangular shape, the second region refers to a region extending along an edge where no wall is formed. In this case, the region extending along the edge where no wall is formed refers to a region extending from the edge where no wall is formed and having one-fifth the entire length of the rectangular shape in the direction orthogonal to the edge. The first region refers to the region other than the aforementioned second region in the bottom of the main body part 10.

Accordingly, in the embodiment, in the attachment of the sub-tank 20 to the bottom of the main body part 10, a greater number of screws 25 are used in a front side region of the bottom where the stiffness is low, and a smaller number of screws 25 are used in a back side region of the bottom where the stiffness is high. Specifically, the sub-tank 20 is fixed with four screws 25 on the front side and with two screws 25 on the back side.

Using a greater number of the screws 25 on the front side as described above for fixing the sub-tank 20 makes a portion of the bottom with low stiffness conform to the sub-tank 20 with high stiffness. On the back side, the sub-tank 20 can be fixed to a portion of the bottom with high stiffness with a smaller number of the screws 25.

Determining the arrangement (number) of the screws 25 for the attachment of the sub-tank 20 based on the distribution of the stiffness of the bottom as in the present invention enables attachment of the sub-tank 20 with a small number of screws 25 while suppressing the deformation of the bottom of the main body part 10. This configuration suppresses increase in cost and decrease in productivity.

Figure 7A:
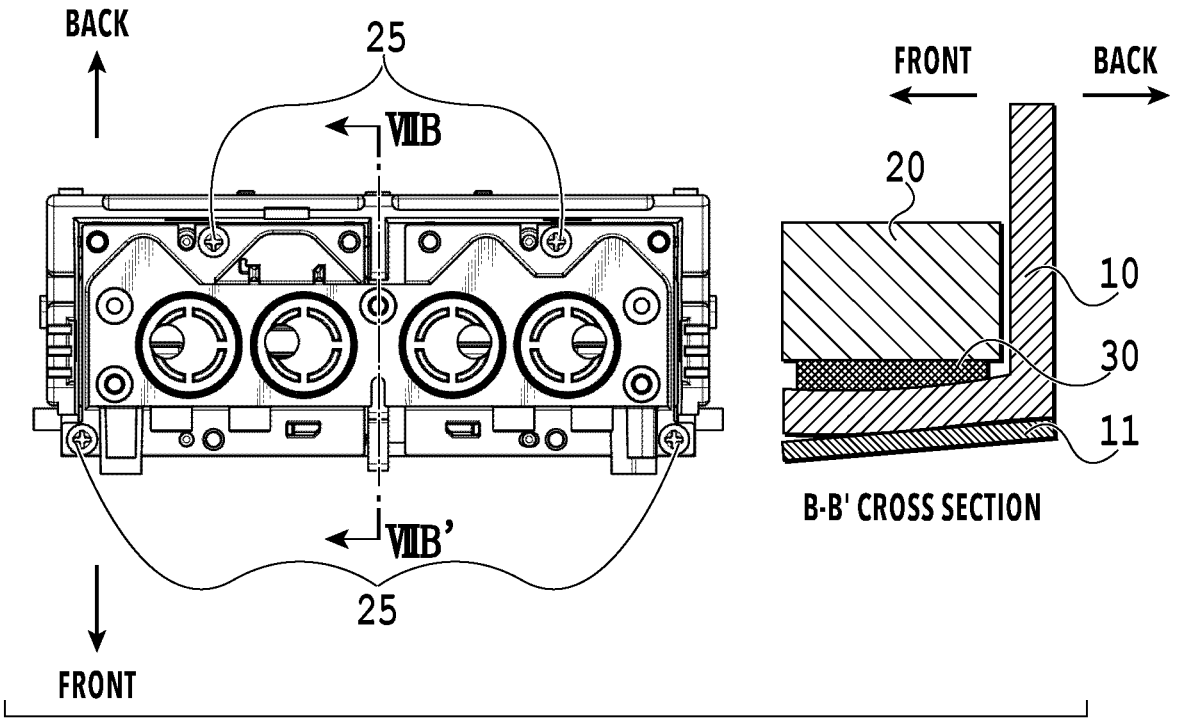
FIG. 7A is a view of a main body part to which a sub-tank is attached.
Figure 7B:
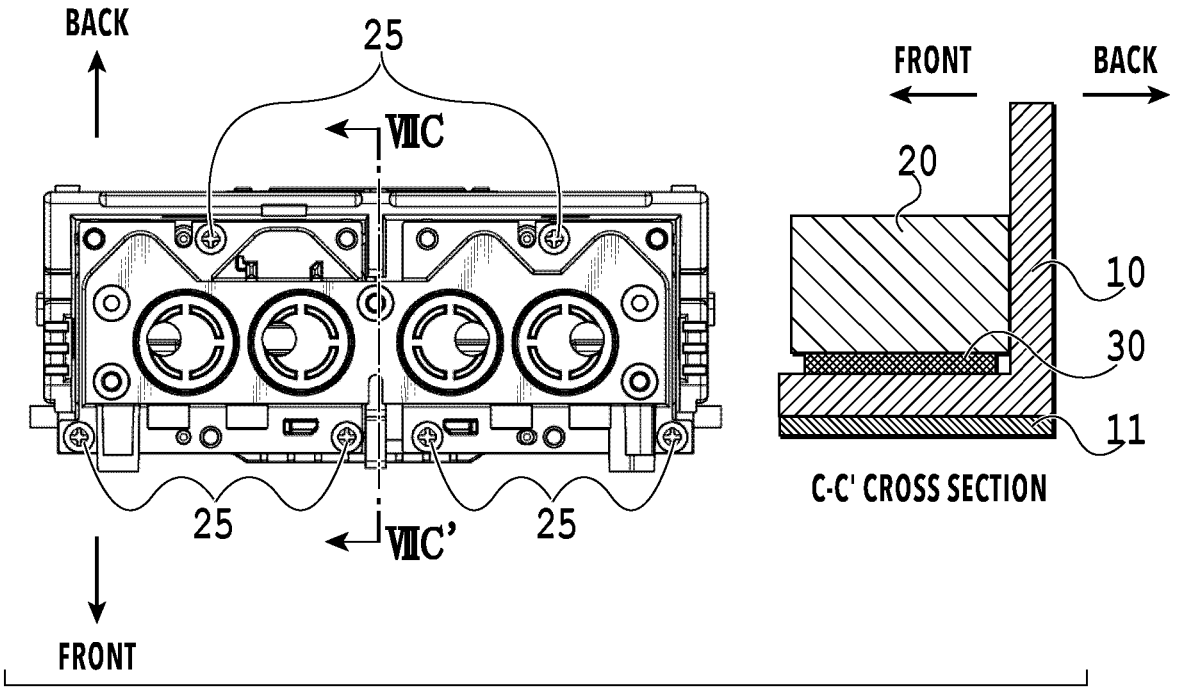
FIG. 7B is a view of a main body part to which a sub-tank is attached.

FIGS. 7A and 7B are diagrams for comparing the main body part 10 on which the sub-tank 20 is attached. FIG. 7A illustrates a comparative example for the embodiment and shows a top view and a cross-sectional view of the main body part 10 to which the sub-tank 20 is fixed with two screws 25 on the front side and with two screws 25 on the back side. FIG. 7B shows a top view and a cross-sectional view of the main body part 10 of the embodiment illustrated in FIG. 6.

As illustrated in FIG. 7A, in the case where the front side center portion is not fixed with screws, and both end portions on the front side are fixed with two screws 25, the front side center portion of the bottom is not fixed to the sub-tank 20. Accordingly, as illustrated in the cross-section VIIB-VIIB' of FIG. 7A, the center portion of the bottom with low stiffness receives an effect of reaction force of the elastic member 30 and deforms. Along with this deformation, there is a possibility that the ejection unit 11 attached on the outside of the bottom of the main body part 10 deforms, decreasing ejection accuracy.

In contrast, as in the embodiment illustrated in FIG. 7B, in the case where the sub-tank 20 is attached to the main body part 10 by fixing the front side with four screws 25, the number of which is greater than the number of screws 25 on the back side, the center portion of the bottom is also fixed to the sub-tank 20 with the screws 25. The center portion of the bottom thus conforms to the sub-tank 20 and the deformation of the bottom can be thereby suppressed.

The four screws 25 on the front side are arranged at positions 4 mm and 44 mm from the center to the left in FIG. 7B and at positions 8 mm and 44 mm from the center to the right in FIG. 7B. The two left and right screws 25 arranged on the back side are each arranged approximately at the middle of the corresponding two screws on the front side, and thus the screws 25 are arranged in a triangular shape on each of the left side and the right side of the sub-tank 20. Specifically, the screws 25 on the back side are arranged at a position 24 mm from the center to the left in FIG. 7B and at a position 26 mm from the center to the right in FIG. 7B.

As described above, the sub-tank 20 is attached to the bottom of the main body part 10 by using a greater number of screws 25 on the front side where the stiffness is low than that on the back side where the stiffness is high. Accordingly, it is possible to provide a liquid ejecting head and a liquid ejecting apparatus that can suppress decrease in ejection accuracy while suppressing increase in cost and decrease in productivity.

Second Embodiment

A second embodiment of the present embodiment is described below with reference to the drawings. Note that, since the basic configuration of the second embodiment is the same as that of the first embodiment, only characteristic features are described below.

Figure 8:
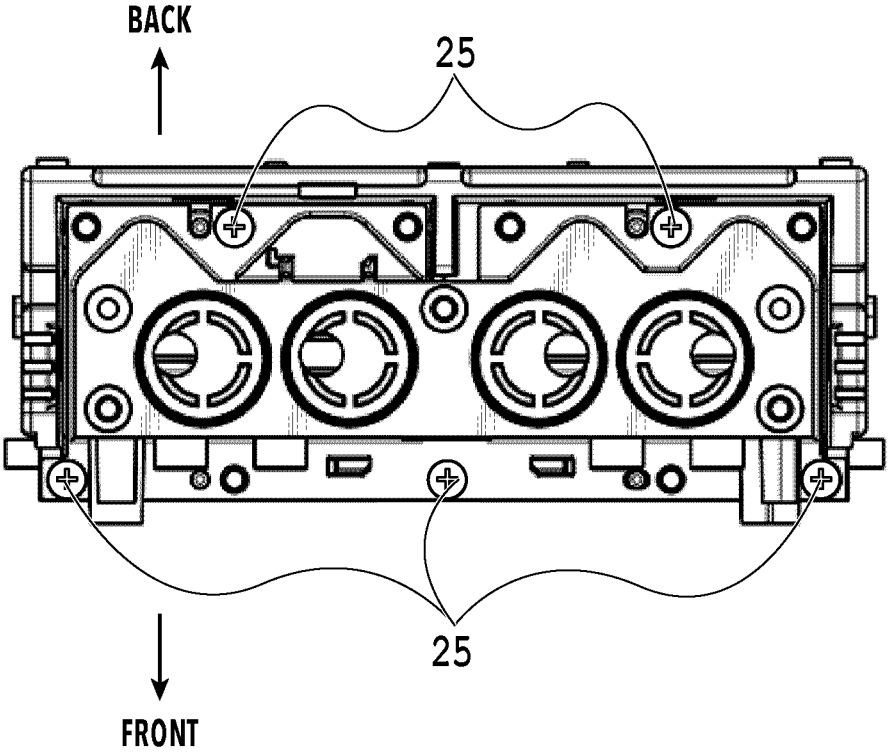
FIG. 8 is a top view of a liquid ejecting head.

FIG. 8 is a top view of the liquid ejecting head 5 of the second embodiment. The number of screws 25 for the attachment of the sub-tank 20 to the main body part 10 may be three on the front side and two on the back side. The three screws 25 on the front side are arranged in the center portion and at the left and right ends. The screws 25 arranged on the back side are at the same positions as those in the first embodiment. Such arrangement of the screws 25 can also suppress the deformation of the main body part 10.

Other Embodiments

Other embodiments of the present invention are described below with reference to the drawings. Note that, since the basic configuration of the other embodiments is the same as that of the first embodiment, only characteristic features are described below.

Figure 9A:
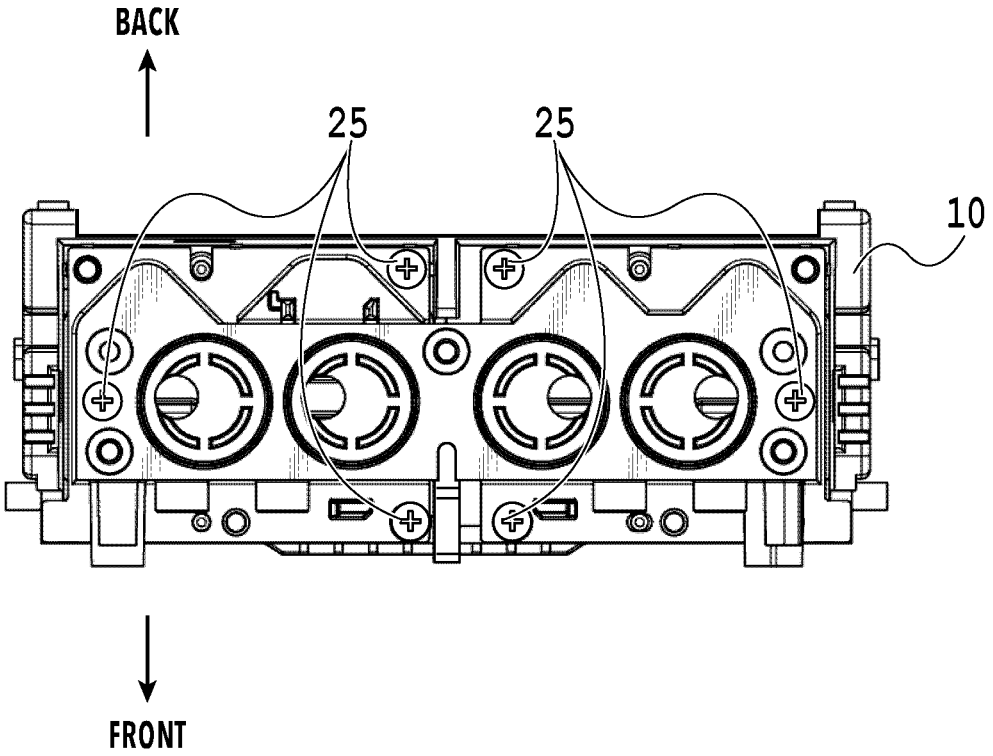
FIG. 9A is a view of a liquid ejecting head.
Figure 9B:
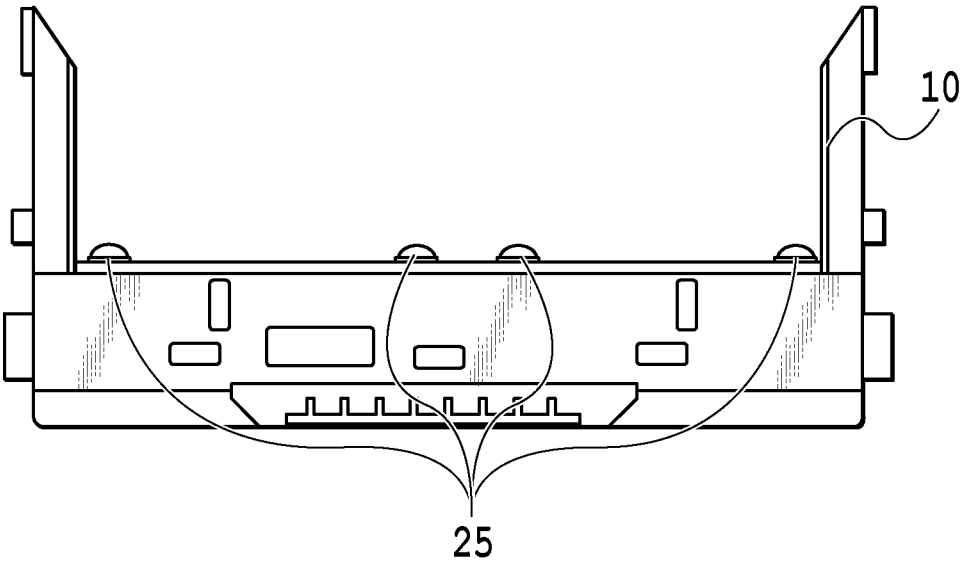
FIG. 9B is a view of the liquid ejecting head.

FIGS. 9A and 9B are a top view and a front view of the liquid ejecting head 5 of the embodiment. FIG. 9A is the top view, and FIG. 9B is the front view. In FIG. 9B, the screws 25 for the attachment are illustrated while the sub-tank 20 is omitted to make the main body part 10 more visible. The main body part 10 in the embodiment has no wall on the back side and has walls on both lateral sides. Specifically, the stiffness of the bottom of the main body part 10 is high in regions adjacent to both end portions provided with the walls and is low in regions adjacent to the center portion where no wall is provided. Accordingly, in the embodiment, the sub-tank 20 is fixed with one screw 25 in each of the end portions of the main body part 10 with high stiffness and with four screws 25 in the center portion with low stiffness. Determining the arrangement of the screws 25 according to the stiffness of the bottom as described above can suppress deformation of the main body part 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-118709 filed Jul. 9, 2020, which is hereby incorporated by reference herein in its entirety.

What is claimed is:

1. A liquid ejecting head comprising:
a tank capable of storing liquid;
a main body part to which the tank is attached; and
an elastic member provided between the tank and the main body part and forming a seal between the tank and the main body part, wherein
a bottom of the main body part includes a first region adjacent to a region provided with a wall standing from an end portion of the bottom and a second region adjacent to a region not provided with the wall,
the wall is formed integrally with the end portion of the bottom,
the tank is attached to the bottom of the main body part by using screws attached to the first region and the second region, and
the number of the screws attached to the second region is greater than the number of the screws attached to the first region.

2. The liquid ejecting head according to claim 1, wherein
the tank is formed of a resin, and
the main body part is formed of a resin with a lower stiffness than that of the resin forming the tank.

3. The liquid ejecting head according to claim 1, wherein
the main body part has a box shape, and
the main body part has the wall at a back and both lateral sides of the box shape and does not have the wall at a front and a top of the box shape.

4. The liquid ejecting head according to claim 3, wherein the tank is attached to the bottom by using four of the screws near the front side of the box shape and two of the screws near the back side of the box shape.

5. The liquid ejecting head according to claim 3, wherein the tank is attached to the bottom by using three of the screws near the front side of the box shape and two of the screws near the back side of the box shape.

6. The liquid ejecting head according to claim 1, further comprising an ejection unit provided on the outside of the bottom and configured to eject the liquid.

7. The liquid ejecting head according to claim 6, wherein a flow passage capable of supplying the liquid to the ejection unit is provided in the bottom.

8. The liquid ejecting head according to claim 1, further comprising a filter provided on the bottom between the tank and the main body part and configured to prevent entrance of dust into the main body part.

9. A liquid ejecting apparatus comprising
a liquid ejecting head including a tank capable of storing liquid, a main body part to which the tank is attached, and an elastic member provided between the tank and the main body part and forming a seal between the tank and the main body part, wherein
a bottom of the main body part includes a first region adjacent to a region provided with a wall standing from an end portion of the bottom and a second region adjacent to a region not provided with the wall,
the wall is formed integrally with the end portion of the bottom,
the tank is attached to the bottom of the main body part by using screws attached to the first region and the second region, and
the number of the screws attached to the second region is greater than the number of the screws attached to the first region.

10. A liquid ejecting head comprising:
a tank capable of storing liquid;
a main body part to which the tank is attached; and
an elastic member provided between the tank and the main body part and forming a seal between the tank and the main body part, wherein
a bottom of the main body part includes a first region adjacent to a region provided with a wall extending from a portion of a periphery of the bottom and a second region adjacent to a region where a wall is not provided extending from a portion of the periphery,
the wall is formed integrally with the portion of the periphery of the bottom,
the tank is attached to the bottom of the main body part by using screws attached to the first region and the second region, and the number of the screws attached to the second region is greater than the number of the screws attached to the first region.

11. The liquid ejecting head according to claim 10, wherein the tank is formed of a resin, and the main body part is formed of a resin with a lower stiffness than that of the resin forming the tank.

12. The liquid ejecting head according to claim 10, wherein the main body part has a box shape, and the main body part has the wall at a back and both lateral sides along the periphery of the box shape and does not have the wall at a front along the periphery and at a top of the box shape.

13. The liquid ejecting head according to claim 12, wherein the tank is attached to the bottom by using four of the screws near the front side of the box shape and two of the screws near the back side of the box shape.

14. The liquid ejecting head according to claim 12, wherein the tank is attached to the bottom by using three of the screws near the front side of the box shape and two of the screws near the back side of the box shape.

15. The liquid ejecting head according to claim 10, further comprising an ejection unit provided on the outside of the bottom and configured to eject the liquid.

16. The liquid ejecting head according to claim 15, wherein a flow passage capable of supplying the liquid to the ejection unit is provided in the bottom.

17. The liquid ejecting head according to claim 10, further comprising a filter provided on the bottom between the tank and the main body part and configured to prevent entrance of dust into the main body part.

18. A liquid ejecting apparatus comprising a liquid ejecting head according to claim 10.

* * * * *